US005704129A

United States Patent [19]

Glesser

[11] Patent Number: 5,704,129

[45] Date of Patent: Jan. 6, 1998

[54] KNIFE WITH REVERSIBLE CLIP

[75] Inventor: Louis S. Glesser, Golden, Colo.

[73] Assignee: Spyderco, Inc., Golden, Colo.

[21] Appl. No.: 651,847

[22] Filed: May 21, 1996

[51] Int. Cl.[6] ..... B26B 1/02

[52] U.S. Cl. ..... 30/155; 30/123

[58] Field of Search ..... 30/123, 142, 143, 30/151, 155, 156, 157, 162

[56] References Cited

U.S. PATENT DOCUMENTS

| | | | |
|---|---|---|---|
| 1,803,899 | 5/1931 | Fuller | 30/155 |
| 4,347,665 | 9/1982 | Glesser | 30/161 |
| 4,447,950 | 5/1984 | Mizelle | 30/155 |
| 5,315,761 | 5/1994 | Norton et al. | 30/162 |
| 5,546,662 | 8/1996 | Seber et al. | 30/161 |

FOREIGN PATENT DOCUMENTS

| | | | |
|---|---|---|---|
| 22620 | of 1898 | United Kingdom | 30/158 |

OTHER PUBLICATIONS

Instruction Sheet and Illustration of Gerber Clip Point Knife.

*Primary Examiner*—Hwei-siu Payer
*Attorney, Agent, or Firm*—Sheridan Ross P.C.

[57] ABSTRACT

A knife having a reversible clip for securing the knife to a user. The clip is advantageously reversible so that the knife can be mounted in the position most comfortable for the user. The clip can be easily reversed and is designed to reduce undesirable rotation of the clip and also to provide a lanyard hole for otherwise securing the knife to the user or another supporting member.

12 Claims, 2 Drawing Sheets

KNIFE WITH REVERSIBLE CLIP

BACKGROUND OF THE INVENTION

1. Field of the Invention

The present invention relates to a knife having a clip adapted to attach the knife to a user, such as on a belt or on the edge of a pocket. More particularly, the present invention relates to a reversible knife clip so that the knife can be comfortably attached to either the left or right side of the user.

2. Description of Related Art

Knives such as pocket knives or folding knives are often provided with means for attaching the knife to the clothing of the user so that the knife is easily accessible. Typically, such attachment means is in the form of an elongated clip that is attached to the knife handle at one end while the opposite end of the clip is fixed in spaced relationship to the outer surface of the handle so that a gap is created adapted to receive and engage a supporting member, such as the pocket or belt of a user. See, for example, U.S. Pat. No. 4,347,665 by Glesser.

Naturally, knife users can be right-handed or left-handed or may otherwise prefer to carry a folding knife on a particular side of their person or in a particular orientation. This is particularly true for a knife that is designed to be held and opened by a person's dominant hand in a particular manner, such as the knife illustrated by U.S. Pat. No. 4,347,665 by Glesser. However, a knife user is typically forced to utilize the attachment means as it is provided from the manufacturer. Thus, many manufacturers make and sell knives having a left-hand orientation or a right-hand orientation.

One attempt to address this problem is illustrated by a pocket clip for a pocketknife sold by Gerber Legendary Blades of Portland, Oreg. This design features a clip that is mountable into a lanyard hole from either side of the knife. The clip is held in place by a simple screw inserted into the opposite side of the lanyard hole.

There are several drawbacks relating to this design. If the screw is not adequately tightened or becomes loose, the clip can easily rotate within the hole and become detached from the user and possibly lost. In addition, the mounting of the clip completely fills in the lanyard hole, thereby removing alternative means for carrying the knife, e.g. by passing a cord through the lanyard hole and attaching the cord to the user or a fixed structure.

SUMMARY OF THE INVENTION

The present invention is directed to a knife having a reversible clip.

According to one aspect of the present invention, the knife includes a blade and a handle functionally attached to the blade wherein the handle has opposed first and second side portions. First and second apertures extend through the first and second side portions, respectively, and a clip is secured to the handle using securing means which extend into at least a portion of one of the apertures to secure the clip onto the handle. The knife advantageously includes means for substantially reducing undesirable rotation of the clip, such as due to excessive force or a loose mounting.

According to one preferred embodiment of this invention, the means for reducing rotation of the clip includes a depression on the handle wherein an end portion of the clip fits securely within the depression to reduce rotation of the clip. Preferably, the depression is substantially non-circular. The knife can advantageously include an aperture through the securing means to provide a lanyard hole for the knife. Preferably, the knife is a folding knife. In one embodiment, a single aperture extends all the way through the handle and the clip is secured using externally and internally threaded screws which extend through the aperture and engage and secure the clip within the depression.

According to another aspect of the present invention, a folding knife is provided having a reversible clip. The knife includes a handle having opposite elongated side portions separated by a spacer defining a cavity therebetween and blade means pivotally mounted on the handle and moveable between alternate positions of being stored within a cavity or being open in an operative position at an extension of the handle. The knife includes a first aperture extending through the handle and clip means also having an aperture on an end portion of the clip when the end portion is mounted over the aperture. Securing means extend through the aperture in the handle to secure the clip to the handle wherein the securing means include a third aperture to provide a lanyard hole for the folding knife when the clip is mounted on the handle.

DETAILED DESCRIPTION

The present invention relates to a knife, such as a pocket knife or a folding knife, that has a removable and reversible clip adapted such that the knife can be comfortably carried by a user in different orientations. The reversible clip according to the present invention is advantageously mounted to reduce rotation of the clip as a result of excess rotational forces or loose mounting. Further, the clip can advantageously be mounted on the knife while leaving a lanyard hole for carrying the knife with a cord or the like.

Figure 1:
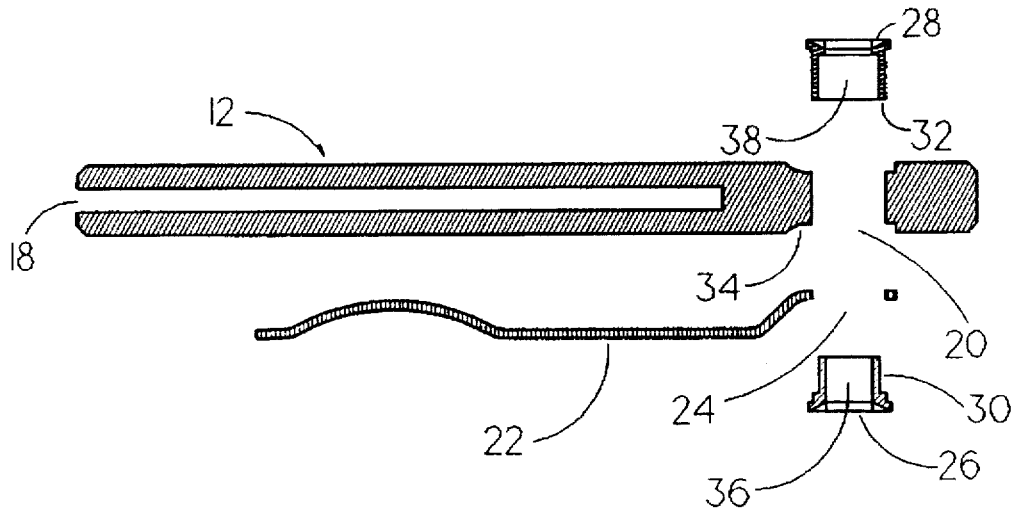
FIG. 1 illustrates a blown apart view of the handle of a folding knife according to an embodiment of the present invention.

FIG. 1 illustrates a blown-apart view of a knife handle according to the present invention. The handle 12 includes two opposed side portions 14 and 16, which define a cavity 18 therebetween. The cavity 18 is adapted to receive a blade when the knife is in the closed position.

According to the present invention, the handle 12 includes an aperture 20. Although illustrated as being located toward the rear portion of the handle 12, it will be appreciated that the aperture 20 can be located virtually anywhere on the handle 12 so long as it does not substantially interfere with the blade or other mechanisms of the folding knife. When no clip is mounted on the handle 12, the aperture 20 can advantageously be used as the lanyard hole whereby a cord can be inserted through the aperture 20 to accommodate carrying the knife or securing the knife to another structure.

It will also be appreciated that the aperture 20 does not have to extend completely through the handle 12, but an aperture could be provided on each side portion 14, 16 to accommodate holding the clip in place. In this case, it would be preferred to provide a lanyard hole elsewhere on the handle.

The clip 22 is an elongate spring-like clip, such as a thin metal piece. The clip 22 includes an opening 24 that is adapted to receive mounting screws 26, 28. As illustrated in FIG. 1, the mounting screws can include two mating screws 26 and 28 which are adapted to secure the clip 22 onto the handle 12. For example, the lower screw 26 can include external threads 30 while the upper screw is internally threaded 32 and adapted to receive the externally threaded lower screw 26.

The mounting screws 26 and 28 also advantageously include apertures 36 and 38 which provide a lanyard hole even when the clip 22 is mounted on the handle. It will be appreciated that other mounting means can be used to attach the clip 22 to the handle 12.

According to the present invention, means for substantially preventing rotation of the clip are also provided. In the embodiment illustrated in FIGS. 1–2, the mounting end of the clip 22 is secured in a depression 34 to prevent substantial rotation of the clip, for example when the screws 26 and 28 are somewhat loose or when excessive rotational force is applied to the clip 12. It is therefore preferable that the depression be substantially non-circular to reduce such rotational movement of the clip. It will be appreciated that other means can be used to reduce rotation of the clip, such as a pin located at some distance from the mounted end of the clip and attaching the clip to the handle. However, the means for reducing rotation should be in addition to the securing means, which can become loose.

It will be appreciated from FIG. 1 that the clip 22 can be mounted on the opposite side of the handle 12, i.e., on the upper side portion 14. Thus, the clip is fully removable and reversible.

Figure 2:
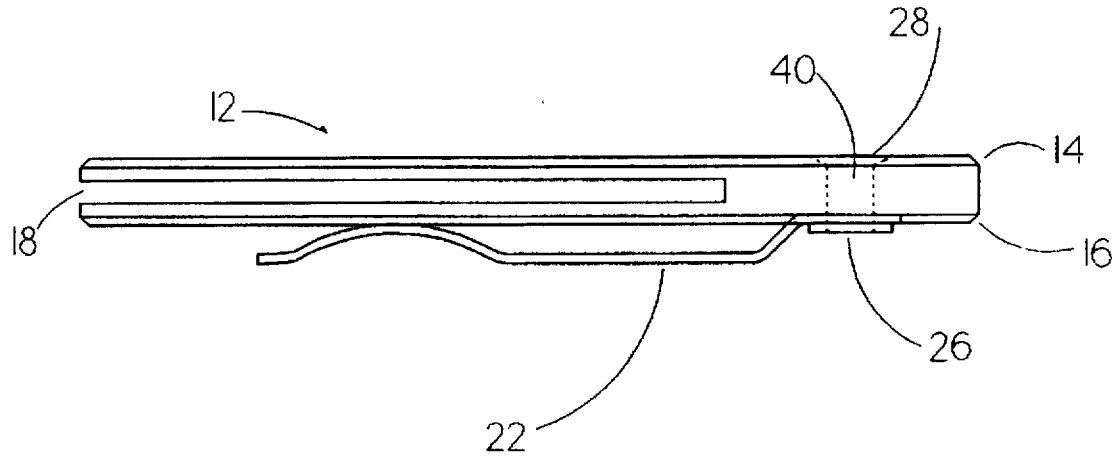
FIG. 2 illustrates a cutaway view of the handle of a folding knife according to an embodiment of the present invention.

FIG. 2 illustrates a cross-sectional view of the knife handle of FIG. 1 that is assembled with the clip 22 in place. The clip 22 is mounted onto the handle 12 and fits snugly within the depression 34 to prevent rotation of the clip. The mounting screws 26 and 28 are tightened into one another to secure the clip 22. A lanyard hole 40 is advantageously formed by the mounting screws which can advantageously receive a cord or the like for carrying or otherwise securing the knife.

Figure 3:
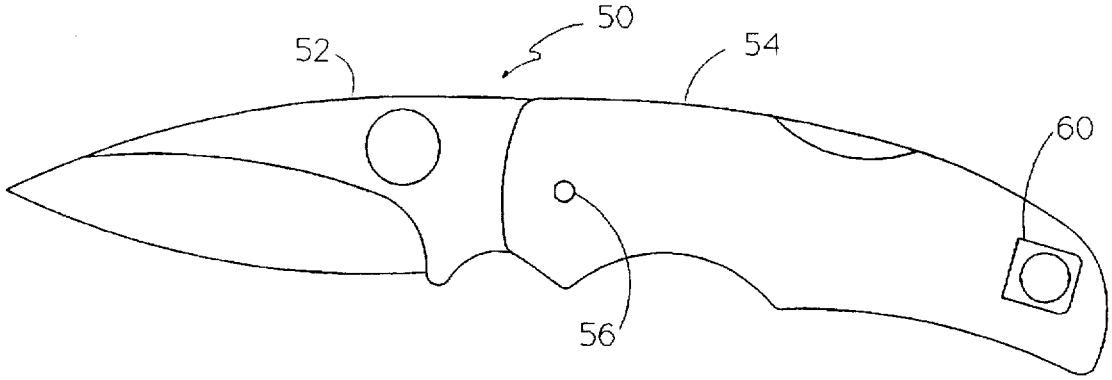
FIG. 3 illustrates a folding knife without the mounted clip according to the present invention.

FIG. 3 illustrates a folding knife 50 according to the present invention without a clip mounted onto the knife. The knife 50 includes a blade portion 52 and a handle portion 54. The blade portion 52 rotates about a point 56 to be secured within the handle portion 54 during non-use.

The handle portion 54 includes a lanyard hole 58 extending through the handle that is adapted to receive the mounting means for a clip. The lanyard hole 58 can receive a cord or the like to secure the knife if desired. The lanyard hole 58 is surrounded by a depression 60 which is adapted to receive the mounting end of a clip. The depression 60 is non-circular, e.g., rectangular, so that the clip cannot substantially rotate when mounted onto the handle.

It will be appreciated that in order to accommodate the reversible clip, the opposite side of the knife 50 would essentially be a mirror image of the illustrated front side of the knife. More particularly, the opposite side of the knife 50 is also provided with a depression that is substantially the same shape as that illustrated on the front side of the knife so that a clip can be mounted on either side.

Figure 4:
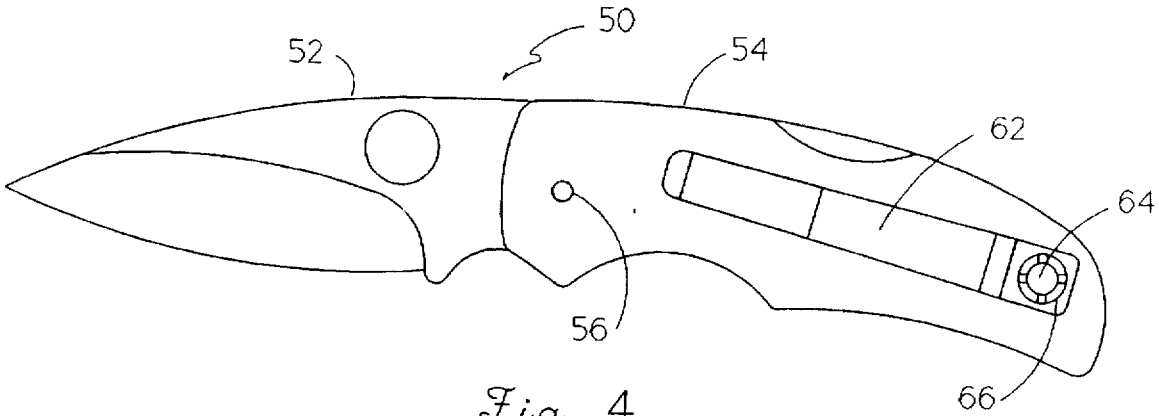
FIG. 4 illustrates a folding knife with a clip according to the present invention.

FIG. 4 illustrates the knife of FIG. 3 with a clip 62 mounted on the handle 54. The clip 62 is mounted with a set screw 66 that extends through the lanyard hole 58. The set screw 66 also includes an aperture 64 that provides a lanyard hole even when the clip is mounted on the knife.

Thus, the present invention provides a knife having a removable and reversible clip that can be mounted on either side of the knife. Undesirable rotation of the clip is advantageously reduced and the mounting of the clip provides a lanyard hole for otherwise securing the knife, such as with a cord.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A folding knife having a reversible clip, comprising:

(a) handle means having a first elongated side portion opposed to a second elongated side portion, said side portions separated by a spacer defining a cavity therebetween;

(b) blade means pivotally mounted on said handle means and moveable between alternate positions of being stored substantially within said cavity or being open in an operative position as an extension of said handle means;

(c) a first aperture extending substantially through said handle means;

(d) a first depression and a second depression located in communication with said first aperture on each of said first and said second side portions, respectively;

(e) clip means comprising an end portion having a second aperture therethrough wherein said end portion is mounted over said first aperture and wherein said end portion of said clip means is adapted to fit securely within one of said depressions and said clip means is adapted to slidably receive a portion of a supporting member; and (f) securing means extending through said first aperture to secure said clip means to said handle means, wherein said securing means comprises a third aperture to provide a lanyard hole for said folding knife when said clip means is mounted on said handle means, wherein said clip means is adapted to be mounted on either of said first or said second side portion.

2. A folding knife having a reversible clip, comprising (a) handle means having a first and a second opposite elongated side portions separated by a spacer defining a cavity therebetween;

(b) blade means pivotally mounted on said handle means and movable between alternate positions of being stored substantially within said cavity or being open in an operative position as an extension of said handle means;

(c) first aperture means extending substantially through said handle means;

(d) clip means comprising an end portion having a second aperture therethrough, wherein when said end portion is mounted over said first aperture means said clip means is adapted to slidably receive a portion of a supporting member, said clip means adapted to be mounted on either of said first elongated side portion or said second elongated side portion; and (e) securing means extending through said first aperture means and said second aperture to secure said clip means, said securing means comprising a third aperture to provide a lanyard hole for said folding knife when said clip means is mounted on said handle means, said securing means further comprising externally threaded screw means and internally threaded screw means adapted to receive said externally threaded screw means and thereby engage and secure said clip means to said handle means.

3. A folding knife as recited in claim 2, wherein said folding knife further comprises means for substantially reducing rotation of said clip means exclusive of said securing means.

4. A folding knife as recited in claim 3, wherein said means for reducing rotation comprises a depression on said handle means and in communication with said first aperture means wherein said end portion of said clip means is adapted to fit securely within said depression.

5. A folding knife as recited in claim 4, wherein said depression is substantially non-circular.

6. A folding knife as recited in claim 5, wherein each of said first and said second side portions comprise a depression and said clip means is adapted to be attached to either of said first and second side portions.

7. A knife having a reversible clip, comprising:

(a) blade means;

(b) handle means functionally attached to said blade means, said handle means comprising opposed first and second side portions;

(c) first aperture means extending substantially through said first side portion and second aperture means extending substantially through said second side portion;

(d) clip means comprising an end portion wherein said clip means is adapted to slidably receive a portion of a supporting member;

(e) securing means adapted to engage both of said first and said second aperture means for securing said end portion onto said handle means, said securing means extending into at least a portion of at least one of said first and said second aperture means to hold said clip means on said handle means; and (f) means for substantially reducing undesirable rotation of said clip means comprising a depression on said handle means wherein said end portion of said clip means is adapted to fit securely within said depression and reduce rotation thereof.

8. A knife as recited in claim 7, wherein said depression is substantially non-circular.

9. A knife as recited in claim 1, wherein said securing means comprises third aperture means to provide a lanyard hole of said knife.

10. A knife as recited in claim 1, wherein said knife is a folding knife.

11. A knife as recited in claim 7, wherein said first and said second aperture means comprise a single continuous aperture that extends substantially through said handle means.

12. A knife as recited in claim 11, wherein said securing means comprises externally threaded screw means and internally threaded screw means adapted to receive said externally threaded screw means and thereby engage and secure said end portion of said clip means within said depression on said handle means.

* * * * *